US006854727B2

(12) United States Patent
Heppenstiel

(10) Patent No.: US 6,854,727 B2
(45) Date of Patent: Feb. 15, 2005

(54) DEVICE FOR KNOCKING OFF SHEET MATERIAL

(75) Inventor: Gerhard Heppenstiel, Bammental (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 181 days.

(21) Appl. No.: 10/135,588

(22) Filed: Apr. 30, 2002

(65) Prior Publication Data

US 2002/0157549 A1 Oct. 31, 2002

(30) Foreign Application Priority Data

Apr. 30, 2001 (DE) ..... 101 21 249

(51) Int. Cl.[7] ..... B41F 5/02
(52) U.S. Cl. ..... 271/304; 101/477
(58) Field of Search ..... 271/82, 308, 311, 271/277; 101/144, 191, 192, 142

(56) References Cited

U.S. PATENT DOCUMENTS

| | | | | | |
|---|---|---|---|---|---|
| 495,483 | A | * | 4/1893 | Goss | 271/187 |
| 614,541 | A | * | 11/1898 | Fischer | 271/82 |
| 774,573 | A | * | 11/1904 | Fenner | 271/307 |
| 1,011,046 | A | * | 12/1911 | Freeman | 271/308 |
| 2,478,053 | A | * | 8/1949 | Pasquinelli | 271/188 |
| 3,239,215 | A | * | 3/1966 | Davis et al. | 271/277 |
| 3,414,259 | A | * | 12/1968 | Koch et al. | 271/82 |
| 3,490,367 | A | * | 1/1970 | Tamaki et al. | 101/144 |
| 4,290,595 | A | * | 9/1981 | Thunker | 271/277 |
| 4,327,641 | A | * | 5/1982 | Goodwin et al. | 101/144 |
| 4,697,512 | A | * | 10/1987 | Simeth | 101/142 |
| 4,838,537 | A | * | 6/1989 | Matsuda et al. | 271/277 |
| 5,762,333 | A | * | 6/1998 | Sugiyama et al. | 271/276 |
| 5,901,955 | A | * | 5/1999 | Klopfenstein | 271/277 |
| 6,048,297 | A | * | 4/2000 | Lange et al. | 493/424 |
| 6,186,500 | B1 | * | 2/2001 | Eugster | 271/277 |
| 6,254,094 | B1 | * | 7/2001 | Becker et al. | 271/309 |
| 6,454,255 | B1 | * | 9/2002 | Allen et al. | 271/176 |
| 6,601,501 | B2 | * | 8/2003 | Takai | 101/118 |
| 6,659,008 | B2 | * | 12/2003 | Mutschall et al. | 101/409 |
| 6,705,221 | B2 | * | 3/2004 | Stephan | 101/230 |
| 6,705,227 | B2 | * | 3/2004 | Becker | 101/409 |

FOREIGN PATENT DOCUMENTS

| | | | |
|---|---|---|---|
| DE | 1118807 | | 12/1961 |
| DE | 4424972 | C2 | 3/1998 |
| DE | 19810237 | A1 | 9/1999 |
| DE | 4424977 | C2 | 8/2000 |
| GB | 0865103 | * | 4/1961 |

* cited by examiner

*Primary Examiner*—Donald P. Walsh
*Assistant Examiner*—Mark J. Beauchaine
(74) *Attorney, Agent, or Firm*—Laurence A. Greenberg; Werner H. Stemer; Ralph E. Locher

(57) ABSTRACT

A knock-off unit for knocking off sheet material from the circumferential surface of an impression cylinder in a rotary printing machine operatable in recto and in recto/verso or perfector printing modes, includes a knock-off device mounted on a rectilinear guide and controllable by a gripper shaft for lifting a leading region of the sheet material off the circumferential surface of the impression cylinder. The knock-off device is coupled via a transmission mechanism to said gripper shaft and, during an outward movement, said knock-off device being extended beyond the circumferential surface of the impression cylinder, initially bridging an idle stroke; an impression cylinder in combination with the knock-off unit; and a printing unit having the knock-off unit.

14 Claims, 3 Drawing Sheets

DEVICE FOR KNOCKING OFF SHEET MATERIAL

BACKGROUND OF THE INVENTION

Field of the Invention

The invention relates to a device for knocking off or repelling sheet material from the circumference of a cylinder carrying the sheet material in a sheet-processing machine.

In sheet-processing machines which are equipped with a reversing or turning device in accordance with the single-drum principle, there is a risk that the sheet will not be gripped at the trailing edge thereof, because the sheet is too short or is folded. After the grippers of an impression cylinder serving as a storage drum have been opened, a free sheet can prevent acceptance of the next following sheet, can trigger a machine stoppage and/or can damage components. In order to avoid such free sheets, ejector devices are used, which introduce the leading edge of a sheet that could not be gripped at the trailing edge thereof because of some irregularity, to a doctor blade or a differently configured sheet guide element, in order to store the sheet thereat temporarily. A misfed sheet removed in this manner from the conveying path of the sheet material, does not hinder the acceptance of a following sheet, if the misfed sheet is led out of the conveying path of the sheet material.

The published German Patent Document DE 44 24 972 A1 discloses a device at sheet-carrying cylinders of a printing machine, whereby the printing machine is able to be operated selectively in recto i.e., first-form, printing mode or in verso, i.e., perfector, printing mode. In the perfector printing or perfecting mode, the sheet is reversed in accordance with the principle of turning the sheet trailing edge. In addition, a sheet diverter or deflector controlled by the gripper shaft or bar is provided in order to lift the front region of the sheet off the circumferential surface of the cylinder. An ejector of the sheet diverter is mounted in a rectilinear guide so that it can neither rotate nor tilt. Furthermore, the ejector is disposed obliquely or at an inclination to the normal, at an angle of preferably 15°.

SUMMARY OF THE INVENTION

Based upon the hereinaforedescribed prior art, it is an object of the invention to provide a device for knocking off sheet material having an ejector with which the avoidance of machine damage is assured.

With the foregoing and other objects in view, there is provided, in accordance with one aspect of the invention, a knock-off unit for knocking off sheet material from the circumferential surface of an impression cylinder in a rotary printing machine operatable in recto and in recto/verso or perfector printing modes, comprising a knock-off device mounted on a rectilinear guide and controllable by a gripper shaft for lifting a leading region of the sheet material off the circumferential surface of the impression cylinder, the knock-off device being coupled via a transmission mechanism to the gripper shaft and, during an outward movement, the knock-off device being extended beyond the circumferential surface of the impression cylinder, initially bridging an idle stroke.

In accordance with another feature of the invention, the transmission mechanism comprises a pivoting lever, a couple and a tilting lever articulatedly connected to one another.

In accordance with a further feature of the invention, the knock-off unit includes a tilting lever bearing whereon the tilting lever is eccentrically mounted.

In accordance with an added feature of the invention, the tilting lever has a first tilting lever arm and a second tilting lever arm, the second tilting lever arm having a lever length exceeding that of the first tilting lever arm.

In accordance with an additional feature of the invention, the knock-off unit further comprises an actuating element for the knock-off device, the actuating element being formed on the second tilting lever arm.

In accordance with yet another feature of the invention, the actuating element is constructed as a roller rotatably mounted on the second tilting lever arm.

In accordance with yet a further feature of the invention, the knock-off unit further comprises a damping, resilient covering provided for the actuating element.

In accordance with yet an added feature of the invention, the knock-off unit further comprises a spring element supported in a spring insert on the tilting lever bearing, the spring element serving for prestressing the knock-off device.

In accordance with yet an additional feature of the invention, the knock-off unit further comprises a cage formed on the knock-off device, the cage having an upper and a lower limit.

In accordance with still another feature of the invention, within a first pivoting travel section of the gripper shaft, the knock-off device bridges an idle stroke and reaches the circumferential surface of the impression cylinder.

In accordance with still a further feature of the invention, within a second pivoting travel section of the gripper shaft, the knock-off device is transferred from the circumferential surface of the impression cylinder into a maximum outwardly extended position of the knock-off device.

In accordance with still an added feature of the invention, the second pivoting travel section of the gripper shaft is about ⅓ of the first pivoting travel section of the gripper shaft.

In accordance with still an additional feature of the invention, through the intermediary of the lever length of the pivoting lever between an upper articulation of the couple and the gripper shaft, and the lever lengths of the first and the second lever arm of the tilting lever, an acceleration of the outwardly extending and inwardly retracting movement of the knock-off device from the circumferential surface of the impression cylinder to the maximum extended position of the knock-off device and the reverse is achievable.

In accordance with another aspect of the invention, there is provided a knock-off unit for knocking off sheet material from the circumferential surface of an impression cylinder in a rotary printing machine operatable in recto and in recto/verso or perfector printing modes, comprising a knock-off device for lifting a leading region of the sheet material off the circumferential surface of the impression cylinder, the knock-off device being coupled via a cylinder selected from the group thereof consisting of electromagnetic and pneumatic cylinders to tilting levers of different lever lengths and, during an outward movement, the knock-off device being extended beyond the circumferential surface of the impression cylinder, initially bridging an idle stroke.

In accordance with a further aspect of the invention, there is provided an impression cylinder for a sheet-processing printing machine operatable in recto and in recto/verso printing modes, in combination with a knock-off unit for knocking off sheet material from the circumferential surface of the impression cylinder, comprising a knock-off device mounted on a rectilinear guide and controllable by a gripper shaft for lifting a leading region of the sheet material off the circumferential surface of the impression cylinder, the knock-off device being coupled via a transmission mechanism to the gripper shaft and, during an outward movement, the knock-off device being extended beyond the circumferential surface of the impression cylinder, initially bridging an idle stroke.

In accordance with a concomitant aspect of the invention, there is provided a printing unit for a sheet-processing printing machine operatable in recto and in recto/verso printing modes, having a knock-off unit for knocking off sheet material from the circumferential surface of an impression cylinder of the printing unit, comprising a knock-off device mounted on a rectilinear guide and controllable by a gripper shaft for lifting a leading region of the sheet material off the circumferential surface of the impression cylinder, the knock-off device being coupled via a transmission mechanism to the gripper shaft and, during an outward movement, the knock-off device being extended beyond the circumferential surface of the impression cylinder, initially bridging an idle stroke.

Advantages deriving from the features according to the invention are primarily that, based upon the gripper shaft movement via an interposed transmission mechanism, an accelerated movement can be impressed upon the knock-off device or repeller, both when it is being retracted and when it is being extended. Due to the selected lengths of the lever arms in the transmission mechanism, initially, an idle stroke within the periphery of the impression cylinder can be bridged, before an accelerated extending movement of the knock-off device from the periphery of the impression cylinder to the maximum extended position of the knock-off device and back therefrom to the periphery of the impression cylinder is carried out. This ensures that, in recto printing mode, the knock-off device can have no contact with the sheet material accepted from the grippers of a reversing drum disposed downstream. Due to the idle stroke of the knock-off device between the periphery of the impression cylinder and the position of the knock-off device retracted to the maximum into the interior of the impression cylinder, closed or partly opened grippers of a transfer cylinder penetrate into the operating region, i.e., the cylinder channel or gap, of the impression cylinder without colliding with the knock-off device, because the latter has been moved out of a potential collision region due to the idle stroke. With the lever arm lengths set on the transmission mechanism, the extending and retracting movement of the knock-off device between the periphery of the printing unit cylinder and the maximum position of the knock-off device can be carried out at a higher speed than the retraction of the knock-off device from the periphery of the impression cylinder, corresponding to the idle stroke, into a maximum retracted position in the interior of the impression cylinder.

In an advantageous development of the concept upon which the invention is based, the transmission mechanism comprises a pivoting lever, a coupler and a tilting lever, which are connected to one another in an articulated manner. The tilting lever of the transmission mechanism can be mounted off-center, i.e., eccentrically, in a lever bearing, so that a first tilting lever arm and a second tilting lever arm are established on the tilting lever, the effective lever length of the second tilting lever arm exceeding the lever arm length of the first tilting lever arm.

The selected transmission ratio of the lever lengths, in particular of the pivoting lever of the transmission mechanism and a tilting lever arm of the tilting lever, and also the range of movement thereof, results in the knock-off device reaching the circumferential surface of the impression cylinder only after about ⅔ of the gripper shaft opening movement. Following a further gripper shaft rotation, the knock-off device is already located in the upper end position thereof, i.e., the maximum extended position thereof. Due to the selected transmission ratio, the extending movement from the periphery of the impression cylinder into the maximum extended position is carried out during a gripper shaft rotation which corresponds to about ⅓ of the gripper shaft rotation, in order to move the knock-off device up to the periphery of the impression cylinder.

In an advantageous development of the concept upon which the invention is based, one end of the tilting lever, which is mounted in a tilting lever bearing at the base of the cylinder channel, has an actuating element assigned thereto. The actuating element can be constructed, for example, as a rotatable roller which is provided with a damping, resilient coating. With an actuating element thus configured in accordance with the invention, low-noise movement of the knock-off device or repeller can be effected. The knock-off device is advantageously prestressed by a spring element, which is supported in an insert surface on the tilting lever bearing in the base of the cylinder channel or gap of the impression cylinder.

The knock-off device, preferably formed as a unipartite structural component, is made of spring strip steel having a reduced mass and is mounted on a rectilinear guide, a cage being formed on the knock-off device, the upper and lower limits of the cage, as viewed in the radial direction of the impression cylinder, forming the contact surfaces for the actuating element accommodated on the tilting lever of the transmission mechanism.

The knock-off device or repeller is moved within a first pivoting travel section of the gripper shaft in such a way that the idle stroke is bridged and the knock-off device reaches the circumferential surface of the impression cylinder. Within a second pivoting travel section of the gripper shaft, the knock-off device is set from the circumferential surface, i.e., the periphery of the impression cylinder, into the maximum extended position of the knock-off device. Due to the lever lengths set in the transmission mechanism, for the extending movement according to the second pivoting travel section of the gripper shaft, only about ⅓ of the first pivoting travel section of the gripper shaft, which is needed by the latter for setting the knock-off device at the periphery of the impression cylinder, is used. Due to the selected lever lengths of the components of the transmission mechanism, i.e., from the length of the pivoting lever between the upper attachment thereof and the gripper shaft, the lever lengths of the lever arms of the tilting lever, an acceleration of the extending and retracting movement of the knock-off device from the circumferential surface of the impression cylinder into the maximum extended position thereof and the reverse is achieved, as compared with the acceleration which the knock-off device experiences when it is set from the maximum position thereof retracted into the interior of the cylinder to the circumferential surface, i.e., the periphery of the printing unit cylinder.

In an alternate embodiment of the concept upon which the invention is based, the knock-off device, instead of being coupled via a transmission mechanism permanently coupled to the gripper shaft, the knock-off device can also be coupled via an electromagnet or a pneumatic cylinder to tilting levers of different lever arm lengths and, during the extending movement to the periphery at the circumferential surface, i.e., the periphery of the printing unit cylinder, can bridge an idle stroke.

The device proposed in accordance with the invention and according to the alternative illustrated embodiments may preferably be used in a sheet-processing rotary printing machine which can be operated selectively in recto printing mode or in recto/verso printing mode, the reversing or turning of the sheet being effected in accordance with the single-drum principle.

Other features which are considered as characteristic for the invention are set forth in the appended claims.

Although the invention is illustrated and described herein as embodied in a device for knocking off sheet material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
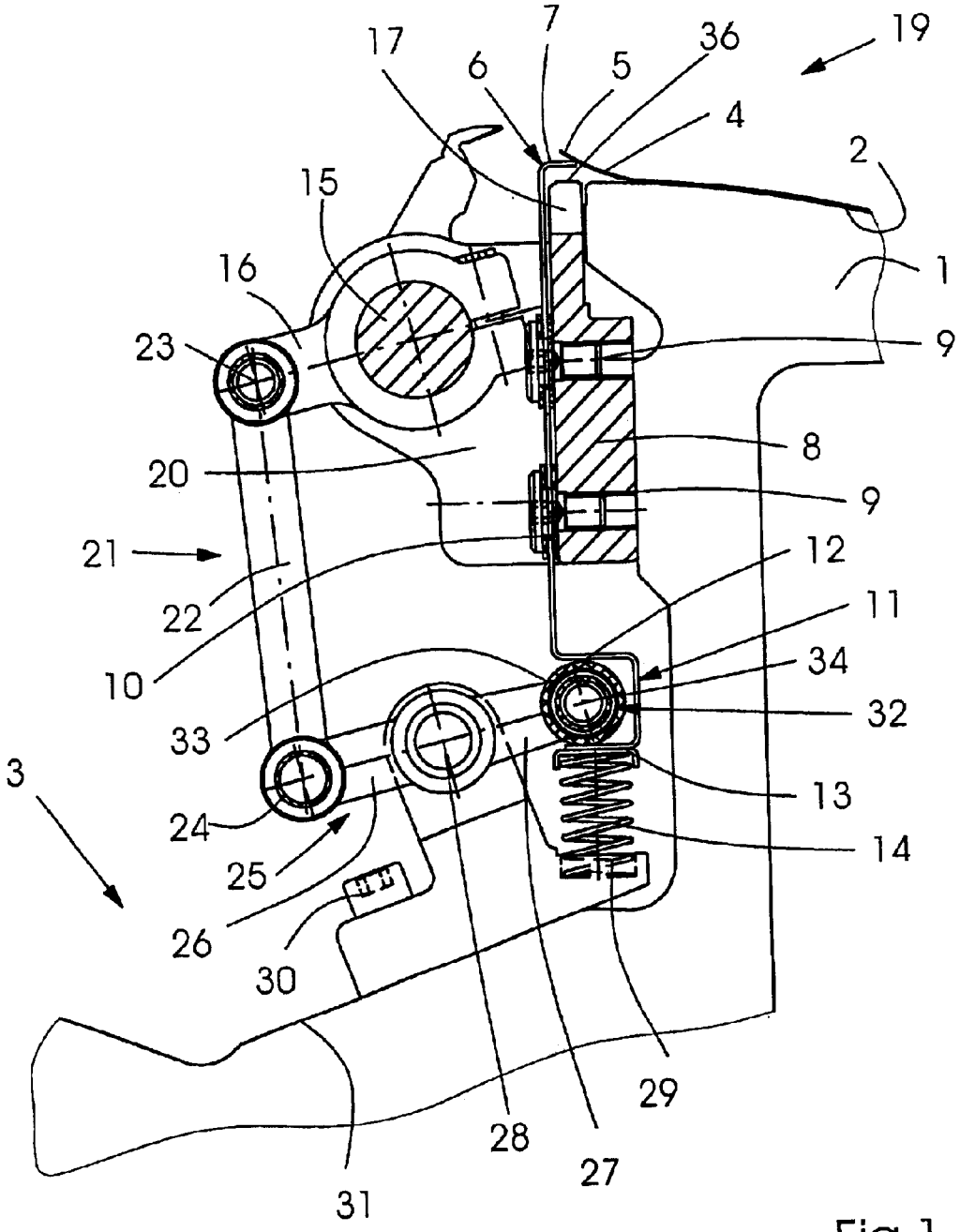
FIG. 1 is a side elevational view, partly in section, of a knock-off device according to the invention, which is connected in a cylinder to a gripper via a couple mechanism, the knock-off device being in an extended position thereof.

Referring now to the drawings and, first, particularly to FIG. 1 thereof, there is shown therein, as noted hereinbefore, a knock-off device or repeller connected to a gripper via a transmission mechanism, the knock-off device being in an extended position thereof.

A cylinder channel or gap 3 is shown formed in an impression cylinder 1 of a printing unit of a rotary printing machine, which can be operated selectively in first-form or recto printing mode or in recto/verso or first-form and perfector printing mode. Accommodated on the circumferential surface 2 of the impression cylinder 1 is a sheet 4 with a leading region thereof shown in the phase illustrated in FIG. 1, which corresponds to the open position of a gripper accommodated on a gripper shaft or bar 15, the leading region of the sheet 4 being lifted off the circumferential surface 2 of the impression cylinder 1 by a knock-off device or repeller 6 in an extended position thereof. An impact surface 7 formed on the knock-off device 6 engages under a leading edge 5 of the sheet 4 and knocks the latter off the circumferential surface 2 of the impression cylinder 1 in the manner shown. Assurance is thereby offered that if the non-illustrated trailing edge of the sheet 4 is not gripped, the sheet 4, due to the knocking off of the leading edge 5 thereof, runs into a non-illustrated guide element, and assurance is provided that the sheet 4 that is thus not gripped does not hinder the acceptance of further following sheets on the circumferential surface 2 of the impression cylinder 1.

The knock-off device 6 with the knock-off or repelling surface 7 formed thereon is accommodated on a rectilinear guide 8, which is screwed to a wall of the cylinder channel 3 by bolts 9 with flat bolt heads 10. The knock-off device 6 can be guided vertically up and down on the rectilinear guide 8. Constructed on the knock-off device 6, which is preferably formed of spring strip steel having reduced mass, is a cage 11, which has an upper limit 12 and a lower limit 13. An actuating element 32 engages in the cage 11 and, as shown in FIG. 1, is formed as a roller 32 rotatably mounted on a tilting lever 25 and provided with a damping covering 33.

Underneath the lower limit 12 of the cage 11, a spring element 14 is provided on the knock-off device 6 and, in turn, is supported in a spring insert 29 of a tilting lever bearing 28 in a lower region 31 of the cylinder gap 3 of the printing unit cylinder 1.

Through the intermediary of the spring element 14, assurance is offered that the knock-off device or repeller 6 is guided without play on the rectilinear guide 8, and the actuating element 32 accommodated on the tilting lever 25 can be guided without play in the cage 11.

Formed on the rectilinear guide 8 in an upper region thereof underneath the knock-off or repelling surface 7 of the knock-off device 6 is a gripper pad 17 for the gripper which is disposed in the open position 19 thereof.

Applied to the wall defining the cylinder gap 3 is a gripper shaft bearing 20 accommodating a gripper shaft or bar 15 actuatable by a non-illustrated cam control system. Mounted on the gripper shaft 15 is a pivoting lever 16, which constitutes a first element of a transmission mechanism 21. At an upper articulation 23, a couple 22 is rotatably secured to the pivoting lever 16, a lower articulation point 24 of the couple 22 being articulatedly connected to a tilting lever 25. The tilting lever 25 is rotatably eccentrically mounted on a tilting lever bearing 28 which, in turn, is secured by screws 30 to the base 31 of the cylinder channel 3. By a selected arrangement of the eccentric mounting of the tilting lever 25 on the tilting lever bearing 28, a first shorter lever arm 26 and a second longer lever arm 27 are formed on the tilting lever 25. The actuating element 32, preferably formed as a rotatably mounted roller, is secured at the free end of the longer lever arm 27 of the tilting lever 25.

A resilient, yieldable coating 33 is applied to the circumference of the actuating element 32 formed as a roller.

Instead of the transmission mechanism 21 shown in FIG. 1, which is made up of the pivoting lever 16, the couple 22 and the tilting lever 25 of different lever-arm lengths 26 and 27, the knock-off device 6, preferably produced from spring strip steel of reduced mass, can also be driven independently of the movement of the gripper shaft or bar 15. For this purpose, the movement of the knock-off device is introduced thereto by an electromagnet or a pneumatic cylinder, via tilting levers having different lever-arm lengths. These components, i.e., the electromagnet and the pneumatic cylinder, respectively, can be switched off and deactivated when the impression cylinder is operated for recto or first-form printing.

Due to the different lever lengths 26 and 27, respectively, which are established on the tilting lever 25, an acceleration of the movement of the knock-off device 6 from the circumferential surface 2 of the cylinder to the maximum extended position 36 thereof is achieved when the gripper shaft 15 is actuated.

Figure 2:
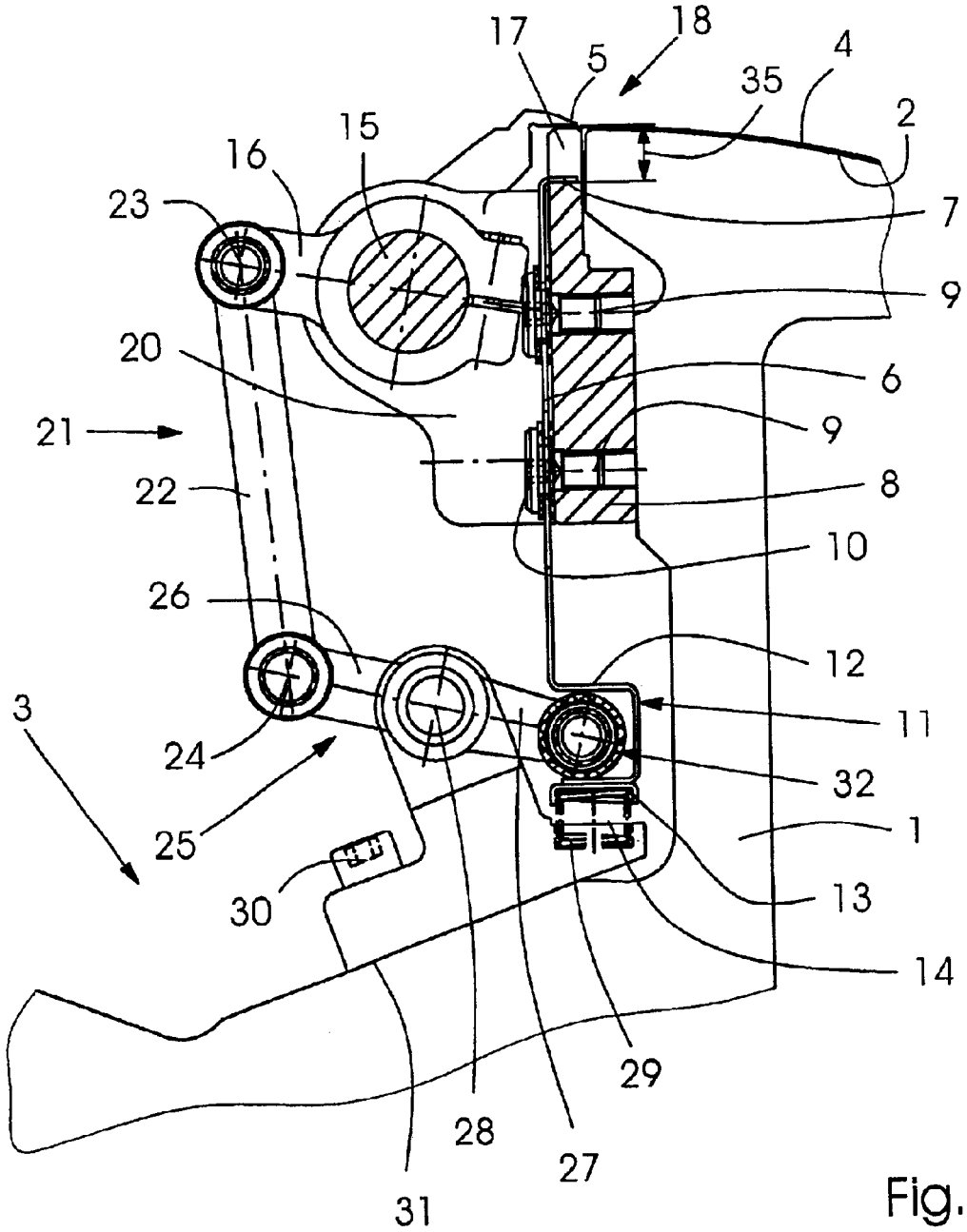
FIG. 2 is a view of FIG. 1 in another operating phase of the knock-off device wherein it is retracted into or below the cylinder periphery.

FIG. 2 shows the knock-off device 6 connected to a gripper via a transmission mechanism 21 in a position wherein it is retracted into the cylinder periphery.

In FIG. 2, the knock-off device 6 is shown in a position wherein it has been moved back below the circumferential surface 2 of the impression cylinder 1 in accordance with an idle stroke travel 35. The result thereof is that, in the region of the grippers mounted on the gripper shaft or bar 15 and gripping the leading edge 5 of a sheet 4, there is clearance for the passage of the closed or partly open grippers of a non-illustrated transfer cylinder, the grippers penetrating into the working region of the knock-off device 6 retracted into the interior of the cylinder periphery of the printing unit cylinder 1. Therefore, due to the resetting of the surface 7 of the knock-off device 6 into the interior of the impression cylinder 1 in accordance with the idle stroke 35, assurance is provided that the knock-off device 6 does not come into contact either with the grippers penetrating partly into the periphery of the impression cylinder 1 or with the sheet.

In the position illustrated in FIG. 2, which corresponds to the closed position 18 of the grippers mounted on the gripper shaft or bar 15, the latter rest on the gripper pad 17. Due to the selected lever lengths on the transmission mechanism 21, an idle stroke travel 35 of the knock-off device 6 within the periphery of the printing unit cylinder 1 is established which is greater than the extension stroke 36 illustrated in FIG. 1 of the surface 7 of the knock-off device 6. The actuating element 32, preferably formed as a rotatable roller, on the tilting lever 25, has moved the knock-off device 6 into the lowermost position thereof in accordance with FIG. 2. In this operating phase, the spring element 14 applied to the knock-off device 6 underneath the lower limit 13 of the cage 11 is compressed down to block length. The spring element 14 is guided in a spring insert 27 on the tilting shaft bearing 28 of the tilting lever 25, so that bending of the spring element 14 under compressive stress is ruled out. Due to the effective lever length of the second tilting lever arm 27, assurance is provided, in the closed position of the grippers mounted on the gripper shaft 15, that the surface 7 of the knock-off device 6 is moved back into the interior of the printing unit cylinder 1 to as far as the upper side of the rectilinear guide 8.

The elements of the transmission mechanism 21, i.e., the pivoting lever 16, the couple 22 and the tilting lever 25 attached to the couple 22, are constructed so as to be maintenance-free to the greatest possible extent; the rotatably mounted roller 32 mounted on the free end of the tilting lever 27 as an actuating element is provided with a damping covering 33, so that occurring shocks are damped to the greatest possible extent. Through the intermediary of the yieldable, resilient covering 33 on the actuating element 32, it is additionally possible for production tolerances with regard to the position of the upper limit 12 and the lower limit 13, respectively, of the cage 11 on the knock-off device or repeller 6 to be compensated for, so that a largely play-free mounting of the actuating element 32 in the cage 11 of the knock-off device 6 can be achieved.

Figure 3:
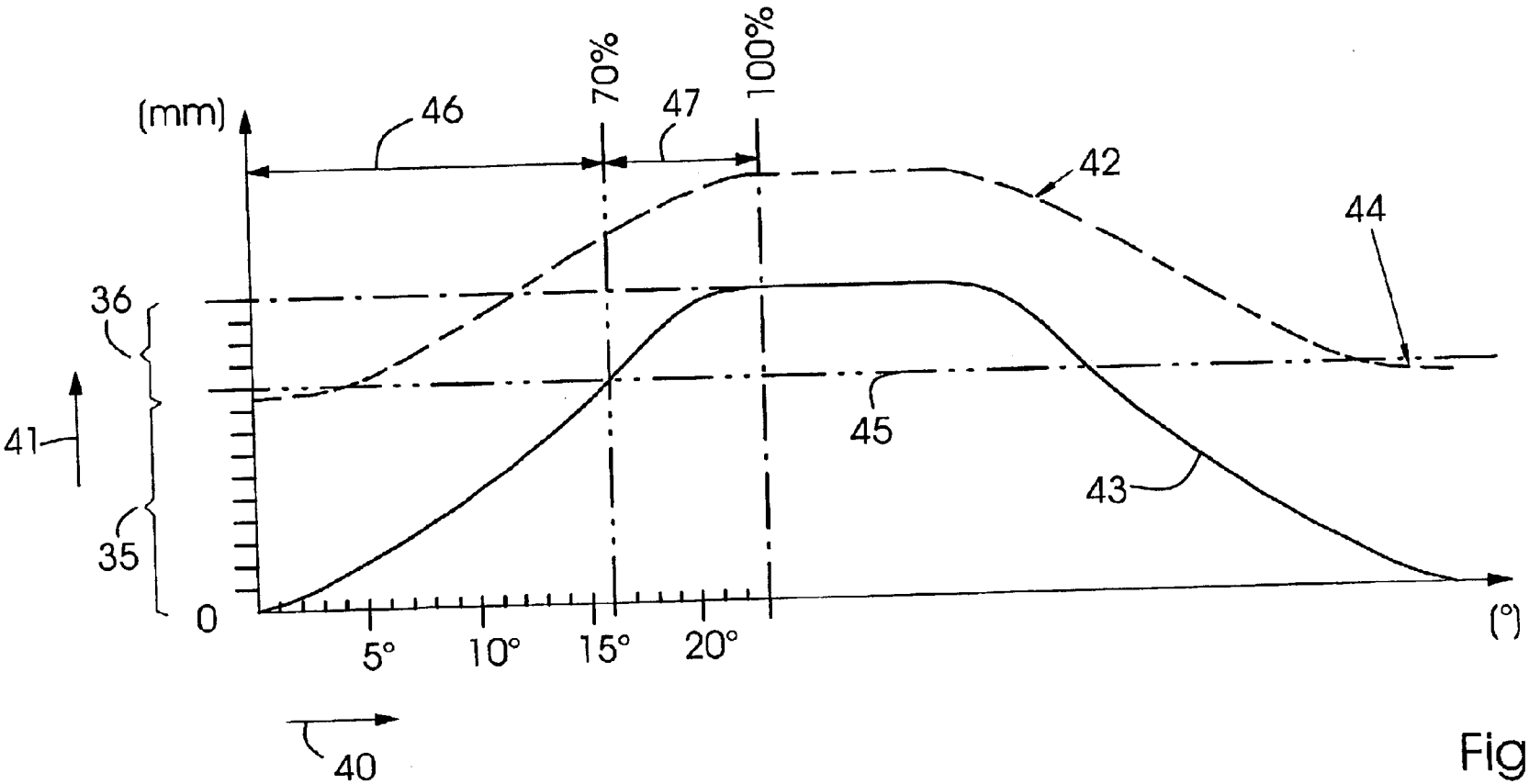
FIG. 3 is a plot diagram showing the courses or characteristic curves of the opening movement of the gripper and of the movement of the knock-off device plotted against the gripper opening angle.

FIG. 3 is a plot diagram revealing the coupling of the courses or characteristic curves of the gripper opening movement and the movement of the knock-off device, plotted against the rotation of the gripper shaft or bar.

Starting from the origin of the plot diagram or graph shown in FIG. 3, which corresponds to the closed position 18 of the grippers shown in FIG. 2 and, therefore, to the closed position of the knock-off device 6 on the contact face of the rectilinear guide 8, the knock-off device 6 and the grippers travel outwardly in accordance with the rotation of the gripper shaft 15 when the latter is actuated by a non-illustrated cam mechanism in the direction of the circumferential surface 2, i.e., the periphery of the printing unit cylinder 1. The lifting movement of the knock-off device 6 and grippers, and of the grippers fixing the leading edge 5 of the sheet 4 is plotted along the axis 41, the course or characteristic curve of the lifting travel of the knock-off device 6 being identified by reference numeral 43, and the course or characteristic curve of the gripper opening movement being identified by reference numeral 42.

When the gripper shaft 15 is being actuated, i.e., rotated, in accordance with a first pivoting travel section 46, the knock-off device 6 travels in accordance with the idle stroke 35 thereof as far as the periphery 45, i.e., the circumferential surface 2, of the printing unit cylinder 1, but has not yet moved into the maximum extended position 36 thereof, according to FIG. 1. In parallel with the extending movement of the knock-off device 6 to the periphery 45 of the printing unit cylinder 1, the grippers mounted on the gripper shaft or bar 15 open. During further rotation of the gripper shaft 15 in accordance with a second pivoting travel section 47, the knock-off device 6 moves into the maximum extended position thereof, identified by reference numeral 36, beyond the circumferential surface 2, i.e., the periphery 45, of the printing unit cylinder 1. Due to the lever relationships selected on the transmission mechanism 21 of the pivoting lever 16 and first tilting lever arm 26 and, in particular, the second tilting lever arm 27, the extending movement of the knock-off device 6 into the maximum position 36 thereof above the circumferential surface 2 of the printing unit cylinder 1 is performed in an accelerated manner. For the extending movement of the gripper shaft 15 from the periphery 45 of the printing unit cylinder 1 to the maximum extended position 36 of the gripper shaft 15 according to the graph in FIG. 3, only about ⅓ of the rotation of the gripper shaft 15 takes place, in comparison with the first pivoting movement section 46 of the gripper shaft 15, which extends the knock-off device 6 to the periphery 45 of the printing unit cylinder 1 in accordance with the idle stroke 35 thereof. This ensures that in the recto printing mode, the knock-off device 6 can have no contact with the sheets accepted from the grippers of a reversing drum.

This is also true for the retracting movement of the knock-off surface 7 of the knock-off device 6 from the maximum position 36 thereof to the periphery 45 of the printing unit cylinder 1. For the retracting movement, only a pivoting movement corresponding to the rotational angle of the gripper shaft 15 and identified by reference numeral 47 is necessary. The second pivoting movement section 47 of the gripper shaft 15 corresponds to about ⅓ of the total pivoting travel of the gripper shaft 15 during the actuation of the grippers carried by the gripper shaft or bar 15 and the knock-off device 6 coupled to the grippers via the transmission mechanism 21. The retracting movement of the knock-off device 6 following the retracting movement of the knock-off device 6 at the maximum extended position 36 to the periphery 45 of the impression cylinder, corresponding to the idle stroke 35 as far as the stop surface of the rectilinear guide 8, is carried out during the first pivoting movement section 46, but in the opposite direction of rotation of the gripper shaft 15. The idle stroke 35 of the knock-off device 6 ensures that the latter retracts into the interior of the impression cylinder 1 to such an extent that partly opened grippers of a transfer cylinder penetrate into the working region of the knock-off device 6 without colliding. Reference numeral 44 identifies the overstroke of the grippers which are mounted on the gripper shaft 15, the grippers, by this overstroke, being settable against the gripper pad 17 for the purpose of reliably gripping the sheet leading edge 5 of the sheet 4.

The individual knock-off devices 6 with knock-off surfaces 7 formed thereon are preferably produced as spring steel strip components with a reduced mass and, in the region wherein they are fixed to the rectilinear guide 8, are provided with slot-like openings. A large number of knock-off or repelling fingers can be fitted to the knock-off device or repeller 6, so that all processable printing-material formats can be covered.

I claim:

1. A knock-off unit for knocking off sheet material from the circumferential surface of an impression cylinder in a rotary printing machine operatable in recto and in recto/verso or perfector printing modes, comprising a knock-off device mounted on a rectilinear guide and controllable by a gripper shaft for lifting a leading region of the sheet material off the circumferential surface of the impression cylinder, said knock-off device being coupled via a transmission mechanism to said gripper shaft and, during an outward movement, said knock-off device being extended beyond the circumferential surface of the impression cylinder, initially bridging an idle stroke, said transmission mechanism including a pivoting lever, a couple and a tilting lever articulatedly connected to one another.

2. The knock-off unit according to claim 1, including a tilting lever bearing whereon said tilting lever is eccentrically mounted.

3. The knock-off unit according to claim 2, further comprising a spring element supported in a spring insert on said tilting lever bearing, said spring element serving for prestressing said knock-off device.

4. The knock-off unit according to claim 1, wherein said tilting lever has a first tilting lever arm and a second tilting lever arm, said second tilting lever arm having a lever length exceeding that of said first tilting lever arm.

5. The knock-off unit according to claim 4, further comprising an actuating element for said knock-off device, said actuating element being formed on said second tilting lever arm.

6. The knock-off unit according to claim 5, wherein said actuating element is constructed as a roller rotatably mounted on said second tilting lever arm.

7. The knock-off unit according to claim 5, further comprising a damping, resilient covering provided for said actuating element.

8. The knock-off unit device according to claim 4, wherein, through the intermediary of the lever length of said pivoting lever between an upper articulation of said couple and said gripper shaft, and the lever lengths of said first and said second lever arm of said tilting lever, an acceleration of the outwardly extending and inwardly retracting movement of said knock-off device from the circumferential surface of the impression cylinder to the maximum extended position of said knock-off device and the reverse is achievable.

9. The knock-off unit according to claim 1, further comprising a cage formed on said knock-off device, said cage having an upper and a lower limit.

10. The knock-off unit according to claim 1, wherein, within a first pivoting travel section of said gripper shaft, said knock-off device bridges an idle stroke and reaches the circumferential surface of the impression cylinder.

11. The knock-off unit according to claim 10, wherein, within a second pivoting travel section of said gripper shaft, said knock-off device is transferred from the circumferential surface of the impression cylinder into a maximum outwardly extended position of said knock-off device.

12. The knock-off unit according to claim 11, wherein said second pivoting travel section of said gripper shaft is about ⅓ of said first pivoting travel section of said gripper shaft.

13. An impression cylinder for a sheet-processing printing machine operatable in recto printing mode and in recto/verso printing modes, in combination with a knock-off unit for knocking off sheet material from the circumferential surface of the impression cylinder, comprising a knock-off device mounted on a rectilinear guide and controllable by a gripper shaft for lifting a leading region of the sheet material off the circumferential surface of the impression cylinder, said knock-off device being coupled via a transmission mechanism to said gripper shaft and, during an outward movement, said knock-off device being extended beyond the circumferential surface of the impression cylinder, initially bridging an idle stroke, said transmission mechanism including a pivoting lever, a couple and a tilting lever articulatedly connected to one another.

14. A printing unit for a sheet-processing printing machine operatable in recto and in recto/verso printing modes, having a knock-off unit for knocking off sheet material from the circumferential surface of an impression cylinder of the printing unit, comprising a knock-off device mounted on a rectilinear guide and controllable by a gripper shaft for lifting a leading region of the sheet material off the circumferential surface of the impression cylinder, said knock-off device being coupled via a transmission mechanism to said gripper shaft and, during an outward movement, said knock-off device being extended beyond the circumferential surface of the impression cylinder, initially bridging an idle stroke, said transmission mechanism including a pivoting lever, a couple and a tilting lever articulatedly connected to one another.

* * * * *